United States Patent [19]

Meyer

[11] Patent Number: 5,022,655

[45] Date of Patent: Jun. 11, 1991

[54] JIGSAW PUZZLE AND TECHNIQUE

[76] Inventor: Karen E. Meyer, 130 C Brebeuf Dr., Penfield, N.Y. 14526

[21] Appl. No.: 394,667

[22] Filed: Aug. 16, 1989

[51] Int. Cl.[5] ..... A63F 9/10

[52] U.S. Cl. ..... 273/157 R

[58] Field of Search ..... 273/157 R

[56] References Cited

U.S. PATENT DOCUMENTS

| | | | |
|---|---|---|---|
| D. 170,113 | 8/1953 | Sibrik et al. | 273/157 R |
| 4,561,097 | 12/1985 | Siegel | 273/157 R |
| 4,792,138 | 12/1988 | Watkins | 273/157 R |

FOREIGN PATENT DOCUMENTS

| | | | |
|---|---|---|---|
| 2395051 | 2/1979 | France | 273/157 R |
| 2182253 | 5/1987 | United Kingdom | 273/157 R |

OTHER PUBLICATIONS

"Games", May 1986, p. 65.

*Primary Examiner*—Edward M. Coven
*Assistant Examiner*—Raleigh W. Chiu
*Attorney, Agent, or Firm*—Robert J. Bird

[57] ABSTRACT

A jigsaw puzzle includes outer straight edge pieces forming a rectangular puzzle perimeter; a number of interior straight edge pieces suggesting an interior rectangle and increasing the proportion of the number of straight edge pieces to the total number of pieces in the puzzle; and a number of joiner pieces, some of the joiner pieces crossing the bounary of the interior polygon, and others of the joiner pieces at positions remote from the boundary.

8 Claims, 3 Drawing Sheets

JIGSAW PUZZLE AND TECHNIQUE

BACKGROUND INFORMATION

The level of difficulty of a jigsaw puzzle, or picture puzzle, depends generally on three factors: (1) the number of pieces; (2) the shapes of the pieces; (3) the composition of the picture.

Jigsaw puzzles of 1000, 1500, and 2000 pieces are typical. Manufacturers of such puzzles depend primarily on the number of pieces to determine their level of difficulty. Because of limited available surface space, many puzzle doers are unable to use the larger puzzles and must therefore miss the challenge they provide. A typical card table (32"×32") will conviently hold a 1000 piece puzzle (26"×20"), both before and after it is assembled. The table will barely hold an assembled 1500 piece puzzle (31"×23.5"), but there is no space for the loose pieces. A 1500 piece puzzle is therefore not practical on a card table. A 2000 piece puzzle cannot be done on a card table.

This invention dramatically increases the level of difficulty of a jigsaw puzzle, and offers a new challenge, without increasing the size of the puzzle or the number of its pieces. The complexity of a larger puzzle is here made available to the smaller puzzle.

SUMMARY OF THE INVENTION

According to one form of the invention, there is provided a jigsaw puzzle including outer straight edge pieces forming a rectangular puzzle perimeter; a number of interior straight edge pieces suggesting an interior rectangle and increasing the proportion of the number of straight edge pieces to the total number of pieces in the puzzle; and a number of joiner pieces, some of the joiner pieces crossing the boundary of the interior polygon, and others of the joiner pieces at positions remote from the boundary.

DETAILED DESCRIPTION

In the usual puzzle of the prior art, the outer edge pieces are the only ones with straight edges. A 1000 piece puzzle includes approximately 125 straight edge pieces, or 12.5% of the total. In putting such puzzles together, it is a common practice, and a relatively simple matter, to first assemble the outer pieces to form the rectangular frame. This leaves only the remaining seven-eighths of the puzzle as "puzzling".

Figure 1:
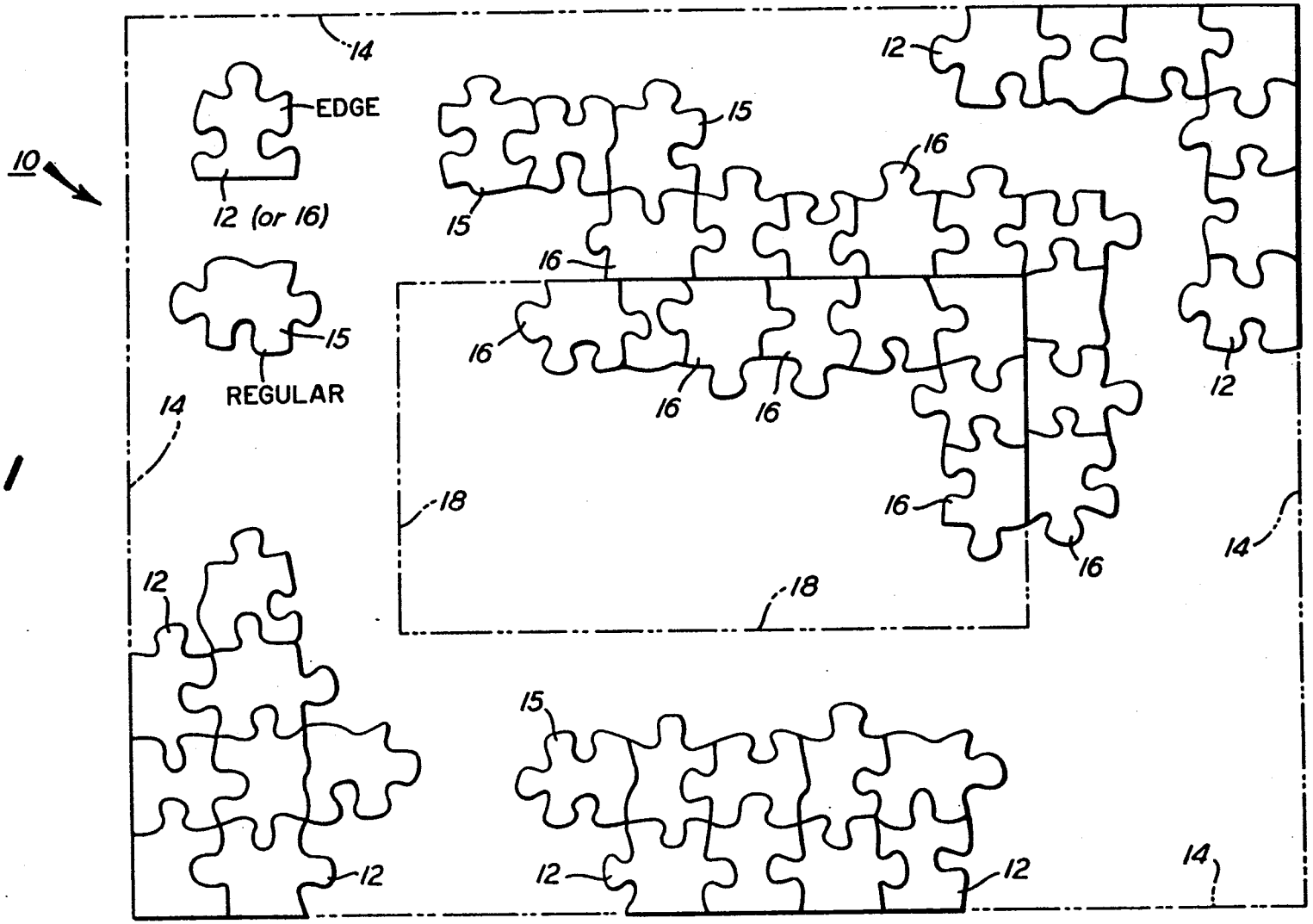
FIG. 1 is a partial plan diagram of a jigsaw puzzle according to this invention.

Referring now to the drawing, FIG. 1 shows the essentials of a jigsaw puzzle 10. The puzzle 10 is a simplified version of about 130 pieces, but serves to illustrate the concept of this invention. The puzzle 10 includes outer edge pieces 12 forming a typical rectangular perimeter 14. This perimetric rectangle 14 is not the only rectangle in the puzzle, however. The puzzle 10 also includes, within the perimeter 14, a number of interior straight edge pieces 16 which together form an interior rectangle 18 within the puzzle. In the illustrative example of FIG. 1, there are roughly as many interior edge pieces 16 as there are outer edge pieces 12. The total number of straight edge pieces in the puzzle is therefore substantially doubled by the provision of interior straight edge pieces 16. The number of corner pieces is, of course, exactly doubled.

In a 1000 piece puzzle there might be a single interior rectangle 18, or there might be two or more such interior rectangles, within the body of the puzzle. The number of straight edge pieces, and their proportion to the whole, increase substantially with each additional interior rectangle. Each interior rectangle also adds four corner pieces to the puzzle.

The interior straight edge pieces 16 raise the level of difficulty of the puzzle also because these edge pieces back up to one another, straight edge to straight edge. That is, the straight edge pieces 16 lie on both sides of the boundary of the interior rectangle 18. This makes the assembly of the interior rectangle(s) more complex than it might appear. It is therefore not an advantageous shortcut to first assemble the interior rectangle(s). In short, the straight edge pieces become much less distinctive and as much a part of the "puzzling" aspect of the puzzle as are the ordinary interior pieces 15. The placement of straight edge pieces is no longer readily apparent as it once was.

Figure 2:
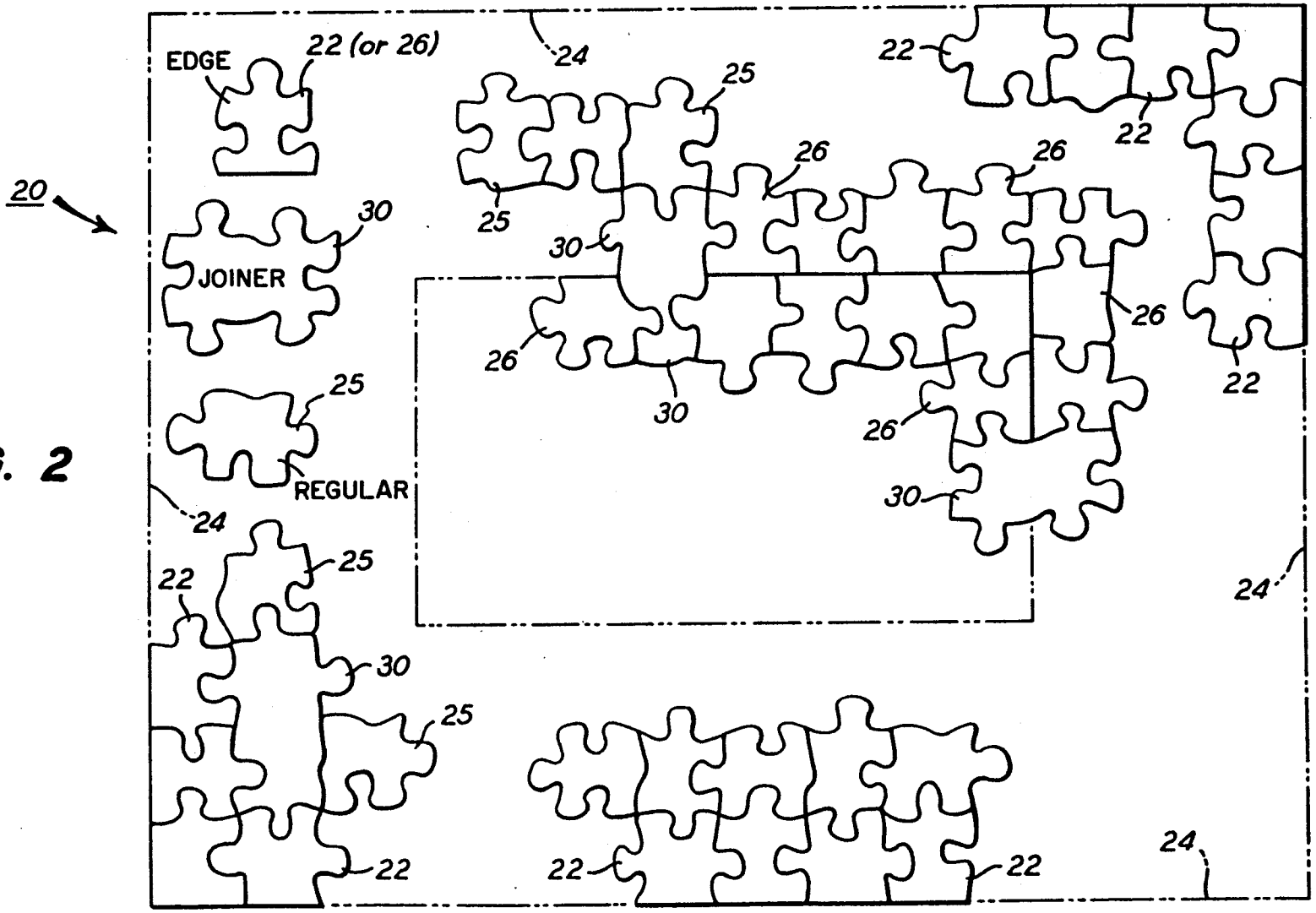
FIG. 2 is a diagram, similar to FIG. 1, showing another version of jigsaw puzzle according to this invention.

FIG. 2 is similar to FIG. 1, showing another form of the puzzle according to this invention. The puzzle 20 in FIG. 2 includes outer edge pieces 22 forming a rectangular perimeter 24, and a number of interior straight edge pieces 26 joining together in the general form of an interior rectangle 28 within the puzzle. The pieces 26 in FIG. 2 do not complete a rectangle, however, as do the straight edge pieces 16 in FIG. 1. A number of "joiner" pieces 30 are included. A joiner piece is a single piece, but is the equivalent of two ordinary pieces "joined" together, and is double the size of an ordinary piece. Two or more of the joiner pieces 30 interrupt and confuse the boundary of the interior rectangle 28. Other joiner pieces are scattered throughout the puzzle, so the puzzle doer cannot assume that the joiner pieces fit only at the rectangle boundary. The joiner pieces 30 are relatively few in number, but they add complexity and another unknown to the puzzle to increase its challenge. "Ordinary" pieces are indicated at 25.

Figure 3:
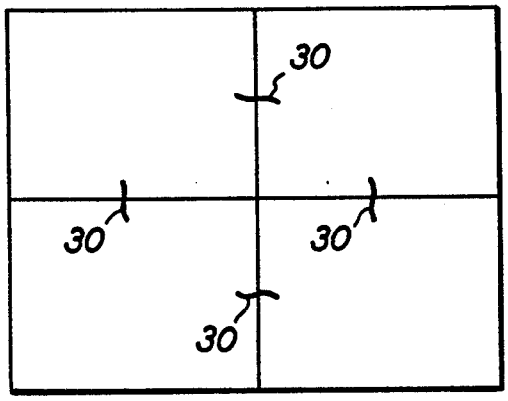
FIGS. 3–6 are schematic representations of variations on the techniques described in detail in connection with FIGS. 1 and 2.
Figure 4:
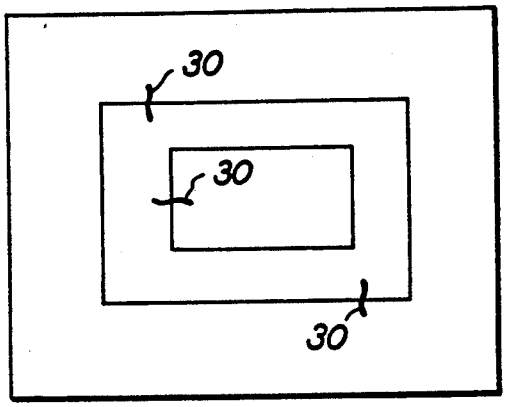
Figure 5:
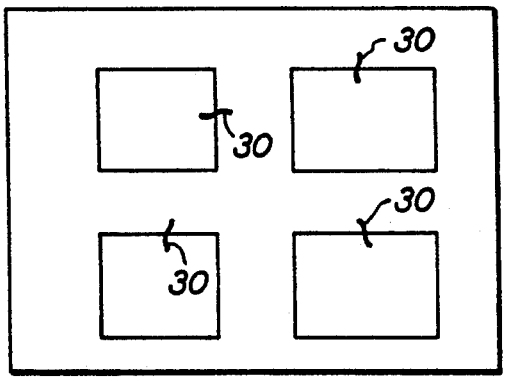
Figure 6:
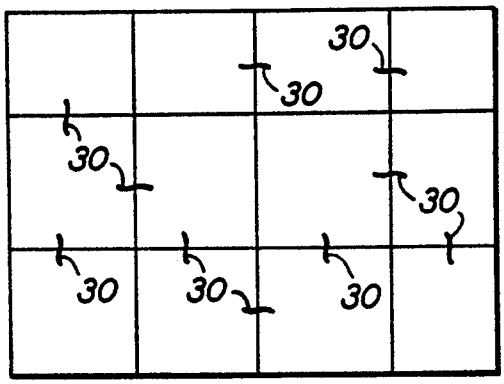

FIGS. 3–6 are schematic representations of variations on the techniques described in detail in connection with FIGS. 1 and 2. These views simply show that the interior rectangles might take many forms. FIG. 3 shows the puzzle divided into quadrants by interior rectangles. FIG. 4 shows one interior rectangle within another. FIG. 5 shows interior rectangles separated from each other within the perimetric rectangle. FIG. 6 shows the puzzle divided into many interior rectangles which together constitute the whole. In FIGS. 3–6, joiner pieces 30 are represented simply as heavy lines crossing the several rectangular boundaries.

As a result of this invention, the level of difficulty of a puzzle is determined not only by the number of pieces and by the composition of the picture, but by the number of interior rectangles within the perimetric rectangle, i.e. the number of straight edge pieces in proportion to the whole. There might be four or five interior rectangles contained within a 2000 piece puzzle. There might be as many straight edge pieces as there are "regular" pieces. The variations of this concept are many.

This technique might also be applied to puzzles of circular or other curved geometry, but it would not have as dramatic an effect on the level of difficulty because the interior edge pieces would, by nature, be either concave or convex and therefore have a distinguishing arc. Other puzzle shapes, such as triangular, might also be used.

This invention relates to "traditional cut" picture puzzles. A traditional puzzle, as illustrated in the drawing, consists of pieces randomly cut, non-uniform and non-repetitive, with wholly irregular convex and concave curved features. Each piece is unique. The pieces interfit in identifiable vertical columns and horizontal rows. Each interior piece is joined to just four other pieces.

The traditional cut puzzle is to be distinguished from puzzles having pieces of recognizable and repetitive geometric configurations, such as polygons or the like, or puzzles which exhibit a scatter cut with no discernible patterns or rows.

The foregoing description of preferred embodiments of this invention is intended as illustrative. The concept and scope of the invention are limited only by the following claims and equivalents thereof.

What is claimed is:

1. A jigsaw puzzle composed of pieces adapted to interfit in orthogonal columns and rows, said puzzle including:

a plurality of outer straight edge pieces defining the perimeter of said puzzle;

a plurality of interior traditional pieces with wholly irregular convex and concave curved features; and a plurality of interior straight edge pieces defining an interior polygon within said perimeter to increase the numerical proportion of straight edge pieces to said interior traditional pieces in said puzzle and, thereby, the difficulty of said puzzle.

2. A jigsaw puzzle as defined in claim 1 in which said perimeter is a rectangle and said interior polygon is a rectangle.

3. A jigsaw puzzle as defined in claim 1, said interior straight edge pieces defining a plurality of said interior polygons within said perimeter.

4. A jigsaw puzzle as defined in claim 3 in which said perimeter is a rectangle and said interior polygons are rectangles.

5. A jigsaw puzzle composed of pieces adapted to interfit in orthogonal columns and rows, said puzzle including:

a plurality of outer edge pieces defining the perimeter of said puzzle;

a plurality of interior tranditional pieces with wholly irregular convex and concave curved features;

a plurality of interior edge pieces within said perimeter suggesting an interior polygon within said perimeter to increase the numerical proportion of straight edge pieces to said interior traditional pieces in said puzzle and thereby, the difficulty of said puzzle; and a plurality of joiner pieces, some of said joiner pieces crossing the boundary of said interior polygon, and other of said joiner pieces disposed at positions remote from said boundary.

6. A jigsaw puzzle as defined in claim 5 in which said perimeter is a rectangle and said interior polygon is a rectangle.

7. A jigsaw puzzle as defined in claim 5, said interior straight edge pieces defining a plurality of said interior polygons within said perimeter.

8. A jigsaw puzzle as defined in claim 7 in which said perimeter is a rectangle and said interior polygons are rectangles.

* * * * *